US011694862B2

(12) United States Patent
Wong

(10) Patent No.: US 11,694,862 B2
(45) Date of Patent: Jul. 4, 2023

(54) LOCK-OFF MECHANISM FOR LOCKING-OFF A TRIGGER ASSEMBLY OF AN ELECTRIC DEVICE

(71) Applicants: DEFOND ELECTECH CO., LTD, Guangdong (CN); DEFOND COMPONENTS LIMITED, Chai Wan (HK)

(72) Inventor: Wai Man Wong, Chai Wan (HK)

(73) Assignees: DEFOND ELECTECH CO., LTD., Guangdong (CN); DEFOND COMPONENTS LIMITED, Chai Wan (HK)

( * ) Notice: Subject to any disclaimer, the term of this patent is extended or adjusted under 35 U.S.C. 154(b) by 0 days.

(21) Appl. No.: 17/095,462

(22) Filed: Nov. 11, 2020

(65) Prior Publication Data

US 2021/0142966 A1 May 13, 2021

(30) Foreign Application Priority Data

Nov. 11, 2019 (HK) ..... 19132095.1

(51) Int. Cl.
*H01H 13/14* (2006.01)
*H01H 13/04* (2006.01)
(Continued)

(52) U.S. Cl.
CPC ..... *H01H 13/14* (2013.01); *B25F 5/02* (2013.01); *H01H 13/04* (2013.01); *H01H 13/52* (2013.01); *H01H 2221/052* (2013.01)

(58) Field of Classification Search
CPC .. H01H 13/14; H01H 13/04; H01H 2221/052; H01H 13/52; H01H 9/22;
(Continued)

(56) References Cited

U.S. PATENT DOCUMENTS 6,958,455 B1 * 10/2005 Lui ..... H01H 3/20 200/321
10,770,245 B2 * 9/2020 Koyama ..... H01H 1/50
(Continued)

FOREIGN PATENT DOCUMENTS

CN 202373494 U 8/2012
CN 102760586 A 10/2012
(Continued)

OTHER PUBLICATIONS

Chinese Search Report for HK 19132095.1, dated Nov. 25, 2019.

*Primary Examiner* — Lheiren Mae A Caroc
(74) *Attorney, Agent, or Firm* — Bryan D. Zerhusen, Esq.; Nicholas R. Herrel, Esq.; Cantor Colburn LLP

(57) ABSTRACT

A trigger switch assembly for use with an electrical device, including: a switch housing; a switch circuit disposed within the switch housing; an actuator rod configured for operable-interaction with a contact lever of the switch circuit; a trigger member having an actuator rod engagement recess configured for receiving a first end of the actuator rod therein, and, a finger-engagement portion configured for engagement by a user's finger so as to urge the actuator rod along the movement axis from the OFF position in to its ON position; and a lock-off mechanism.

11 Claims, 6 Drawing Sheets

(51) Int. Cl.
*B25F 5/02* (2006.01)
*H01H 13/52* (2006.01)

(58) Field of Classification Search
CPC ..... H01H 3/32; H01H 9/20; H01H 9/223; H01H 9/24; H01H 9/28; H01H 9/286; B25F 5/02
See application file for complete search history.

(56) References Cited

U.S. PATENT DOCUMENTS

| | | | | |
|---|---|---|---|---|
| 2011/0308920 | A1* | 12/2011 | Shi | B25F 5/02 200/43.17 |
| 2021/0304977 | A1* | 9/2021 | Osaki | H01H 13/20 |

FOREIGN PATENT DOCUMENTS

| | | | |
|---|---|---|---|
| CN | 104240989 | A | 12/2014 |
| WO | WO 2018/193549 | A1 | 10/2018 |

* cited by examiner

LOCK-OFF MECHANISM FOR LOCKING-OFF A TRIGGER ASSEMBLY OF AN ELECTRIC DEVICE

CROSS-REFERENCE TO RELATED APPLICATIONS

The present application claims priority to Hong Kong Short Term Patent Application No. 19132095.1, filed 11 Nov. 2019 and titled A Lock-Off Mechanism for Locking-Off A Trigger Assembly of An Electric Device, which is incorporated by reference herein in its entirety for all purposes.

FIELD OF THE INVENTION

The description relates to lock-off mechanisms for trigger assemblies of electric power tools and the like.

BACKGROUND OF THE INVENTION

Certain existing electric power tools include a trigger assembly for operation of the electric power tool. The trigger assembly will typically comprise a trigger member with a finger-engagement portion which when squeezed by the user's finger causes an actuator rod to move linearly inwardly of a switch housing so as to effect closure of a switch circuit inside of the switch housing and thereby turn the electric power tool ON. In the ON state, power from a battery may be connected to an electric motor of the electric power tool via the closed switch circuit. The electric power tool will typically also include a lock-off mechanism to safeguard the actuator rod from being moved inwardly of the switch housing to turn the device on when force is accidentally applied to the trigger by the user's finger. Unfortunately, it has been found that in certain existing devices, the actuator rod may still be moved inwardly of the switch housing so as to turn the switch circuit on even when the lock-off mechanism is engaged. In particular, this tends to be the case when the trigger member is squeezed at a lower end whereby the trigger member is able to pivot about a portion of the lock-off mechanism so as to apply sufficient force to overcome the lock-off mechanism and drive the actuator rod inwardly of the switch housing.

SUMMARY OF THE INVENTION

The present invention seeks to alleviate at least one of the above-described problems.

The present invention may involve several broad forms. Embodiments of the present invention may include one or any combination of the different broad forms herein described.

In one broad form, the present invention provides a trigger switch assembly for use with an electrical device, including:

a switch housing;

a switch circuit disposed within the switch housing, said switch circuit including a movable contact member mounted on a contact lever and a stationary contact member, wherein said contact lever is movable between at least one of a first configuration in which the movable contact member is not in contact with the stationary contact member so as to open the switch circuit, and, a second configuration in which the movable contact member is in contact with the stationary contact member so as to close the switch circuit;

an actuator rod configured for operable-interaction with the contact lever, wherein said actuator rod is configured for movement along an actuator movement axis relative to the switch housing between at least one of an OFF position in which the contact lever is arranged in to the first configuration whereby the switch circuit is opened, and, an ON position in which the contact lever is arranged in to the second configuration whereby the switch circuit is closed;

a trigger member having an actuator rod engagement recess configured for receiving a first end of the actuator rod therein, and, a finger-engagement portion configured for engagement by a user's finger so as to urge the actuator rod along the movement axis from the OFF position in to its ON position;

a lock-off mechanism including a first lock-off member disposed on the trigger member and a second lock-off member coupled to the housing that are configured for selectable movement relative to each other between at least one of a locked-off configuration whereby they restrict movement of the actuator rod along the movement axis from the OFF position in to the ON position, and, a non-locked-off configuration whereby they do not restrict movement of the actuator rod along the movement axis from the OFF position in to the ON position; and wherein when the first and second lock-off members are arranged in to the locked-off configuration, the first and second lock-off members are shaped and dimensioned so that the actuator rod is restricted from moving along the movement axis from the OFF position in to the ON position in response to urging by the trigger member as the trigger member is pivoted or bent about an edge of the second lock-off member.

Preferably, the first and second lock-off members may include stepped-shapes that may be configured to complement each other when arranged in the locked-off configuration.

Preferably, a portion of the stepped-shape of the second lock-off member may be configured to obstruct movement of the first lock-off member in a direction towards the actuator rod when the first and second lock-off members are arranged in the locked-off configuration.

Preferably, the actuator rod may be configured to be received in to the engagement recess of the trigger member disposed on a first side of the trigger member, and wherein the first and second lock-off members may be shaped and dimensioned to extend along the first side of the trigger member substantially between the actuator engagement recess and a corner of the trigger member.

Preferably, the present invention may include a lever operably-connected with the second lock-off member wherein said lever may be operable to move the second lock-off member between locked-off and non-locked-off configurations with the first lock-off member.

Preferably, the first lock-off member may be integrally formed with the trigger member.

Preferably, the second lock-off member may be coupled to the switch housing.

Preferably, the trigger member may be integrally formed from molded plastic material.

Preferably, the electrical device may include at least one of an electric power tool and an electric gardening tool.

In another broad form, the present invention provides a trigger switch assembly for use with an electrical device, including:

a switch housing;

a switch circuit disposed within the switch housing, said switch circuit including a movable contact member and a stationary contact member, wherein said movable contact member is configured for movement between at least one of a first configuration in which the movable contact member is not in contact with the stationary contact member so as to open the switch circuit, and, a second configuration in which the movable contact member is in contact with the stationary contact member so as to close the switch circuit;

an actuator rod configured for operable-interaction with the contact lever, wherein said actuator rod is configured for movement along an actuator movement axis relative to the switch housing between at least one of an OFF position in which the contact lever is arranged in to the first configuration whereby the switch circuit is opened, and, an ON position in which the contact lever is arranged in to the second configuration whereby the switch circuit is closed;

a trigger member having an actuator rod engagement recess configured for receiving a first end of the actuator rod therein, and, a finger-engagement portion configured for engagement by a user's finger so as to urge the actuator rod along the movement axis from the OFF position in to its ON position;

a lock-off mechanism including a first lock-off member disposed on the trigger member and a second lock-off member coupled to the housing that are configured for selectable movement relative to each other between at least one of a locked-off configuration whereby they restrict movement of the actuator rod along the movement axis from the OFF position in to the ON position, and, a non-locked-off configuration whereby they do not restrict movement of the actuator rod along the movement axis from the OFF position in to the ON position; and wherein when the first and second lock-off members are arranged in to the locked-off configuration, the first and second lock-off members are shaped and dimensioned so that the actuator rod is restricted from moving along the movement axis from the OFF position in to the ON position in response to urging by the trigger member as the trigger member is pivoted or bent about an edge of the second lock-off member.

BRIEF DESCRIPTION OF THE DRAWINGS

The present invention will become more fully understood from the following detailed description of a preferred but non-limiting embodiments thereof, described in connection with the accompanying drawings, wherein.

DETAILED DESCRIPTION OF THE INVENTION

Preferred embodiments of the present invention will now be described herein with reference to FIGS. 1 to 6. The embodiments comprise a trigger assembly for use with an electric power tool having an electric motor including for instance an electric drill, grinder, sander, saw, rotary driving tool and the like. More particularly, the embodiments described herein comprise trigger assemblies having a locking-off mechanism to prevent the trigger from being squeezed to actuate operation of the electric power tool. It would be appreciated and understood that whilst this embodiment is described for use with an electric power tool, this is merely for purposes of illustrating functionality and alternate embodiments of the present invention may of course be used with other types of electric devices such as electric gardening tools and the like.

Figure 1:
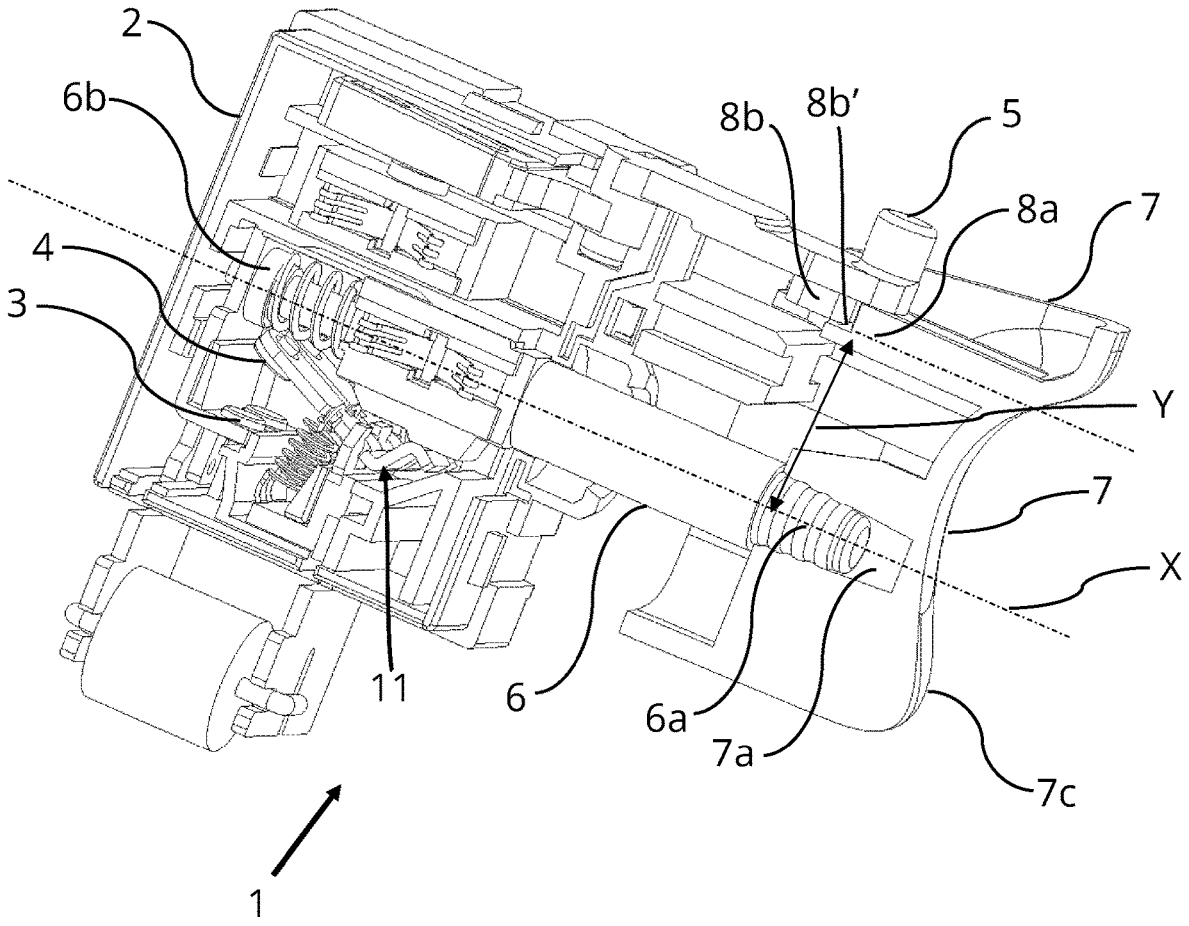
Prior Art FIG. 1
FIGS. 1 and 2 show aspects of a trigger switch assembly for an electric power tool with a conventional-type lock-off mechanism.
Figure 2:
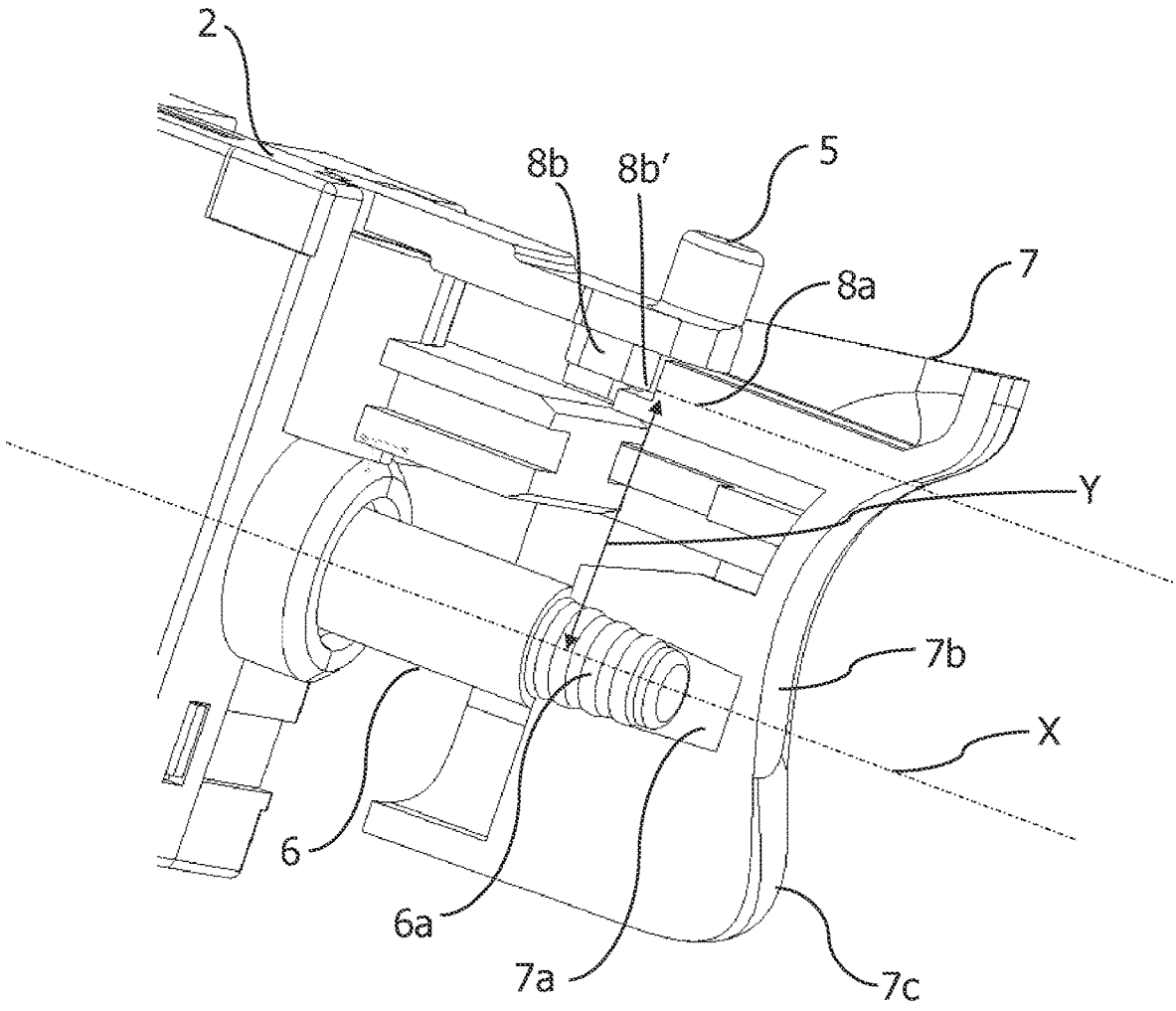
Prior Art FIG. 2
Figure 3:
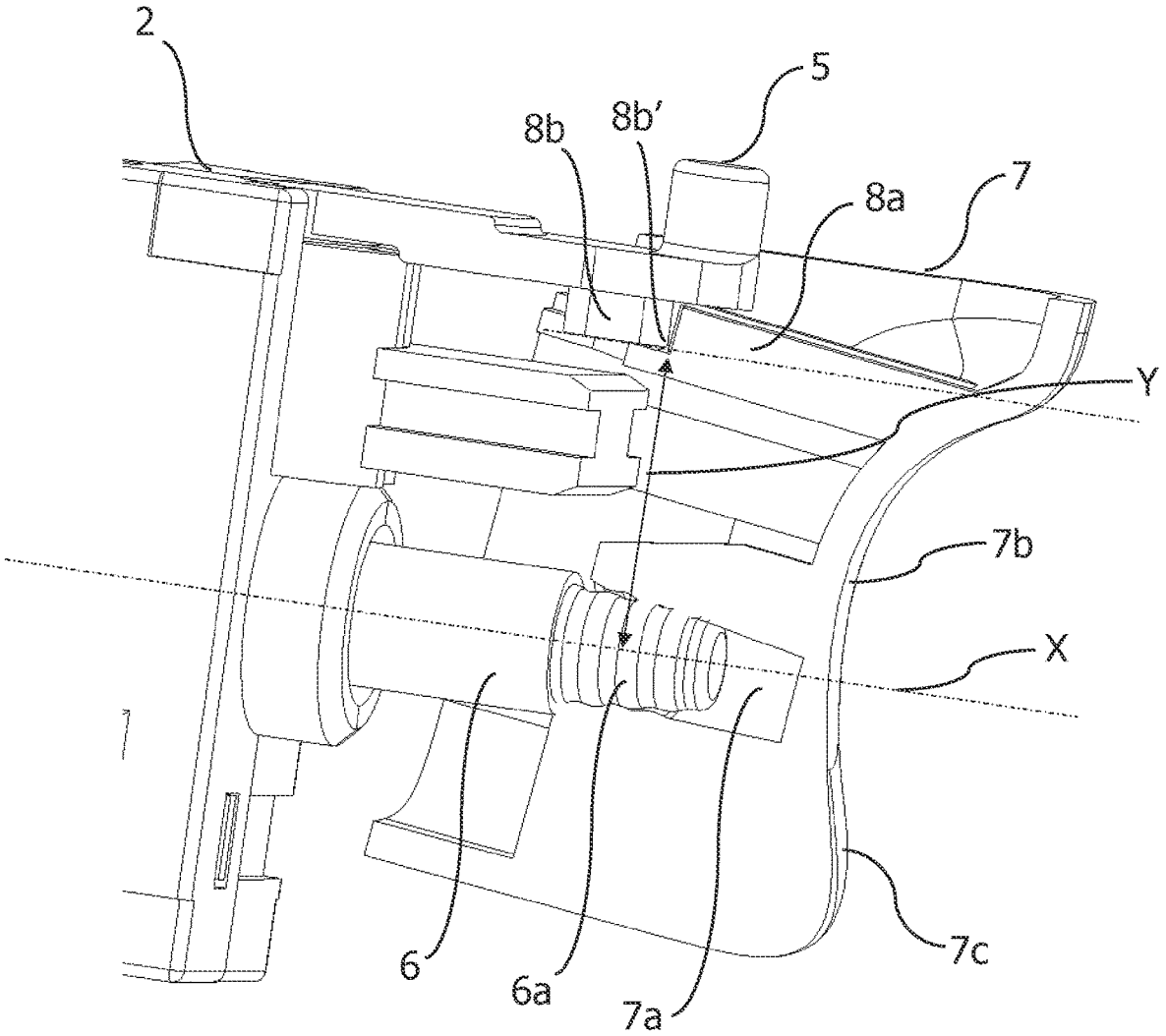
Prior Art FIG. 3
FIG. 3 shows an aspect of the conventional type lock-off mechanism in FIGS. 1 and 2 whereby the actuator rod is still able to be urged inwardly of the housing to an ON position, even when the arranged in a locked-off configuration, when force is applied to a lower end of the trigger member to pivot or bent the trigger member about an edge of the lock-off mechanism.

Referring firstly to FIGS. 1 to 3, various aspects of a conventional trigger assembly (1) are shown including a switch housing (2) with a switch circuit disposed therein. The switch circuit includes a movable contact member (4) mounted on a contact lever (11) and a stationary contact member (3). The contact lever is movable between a first configuration in which the movable contact member (4) is not in contact with the stationary contact member (3) so as to open the switch circuit, and, a second configuration in which the movable contact member (4) is in contact with the stationary contact member (3) so as to close the switch circuit. In alternate embodiments, the movable contact member (4) may be moved by alternate mechanisms to that of a contact lever (for instance, a sliding carriage) without departing from the spirit of the present invention. An actuator rod (6) is configured for movement along an actuator movement axis (X) relative to the switch housing (2) between an OFF position (i.e. when the actuator rod is relatively extended from the switch housing) in which the contact lever is arranged in to the first configuration whereby the switch circuit is opened, and, an ON position in which it urges the contact lever in to the second configuration whereby the switch circuit is closed. The actuator rod is biased on to the OFF position by a return spring. The trigger assembly (1) further includes a trigger member (7) having an actuator rod engagement recess (7*a*) configured for receiving a first end (6*a*) of the actuator rod (6) therein. A second distal end (6*b*) of the actuator rod (6) is located within the switch housing (2). The trigger member (7) also includes a finger-engagement portion (7*b*) configured for engagement by a user's finger whereby when pressure is ordinarily applied to the finger-engagement portion (7*b*) by the user's finger, the trigger member (7) urges the actuator rod (6) inwardly of the switch housing (2) along the movement axis (X) from the OFF position in to its ON position. The conventional trigger assembly (1) also includes a lock-off mechanism (8*a*,8*b*) having a first lock-off member (8*a*) disposed on the trigger member (7) and a second lock-off member (8*b*) coupled to the switch housing (2) that are configured for selectable movement relative to each other between at least one of a locked-off configuration whereby they are arranged to co-operatively restrict movement of the actuator rod (6) along the movement axis (X) from the OFF position in to the ON position, and, a non-locked-off configuration whereby they do not restrict movement of the actuator rod (6) along the movement axis (X) from the OFF position in to the ON position. The first lock-off member (8*a*) may be integrally-formed with the trigger member (7), for instance, as a single molded plastic piece. The second lock-off member (8*b*) is operably-connected to a lever (5) whereby the second lock-off member (8*b*) is selectably movable by the operation of the lever (5) in and out of the locked-off configuration with the first lock-off member (8*a*). Conventional lock-off mechanisms such as that depicted in FIGS. 1 to 3 will generally restrict movement of the actuator rod (6) inwardly of the switching housing from the OFF position in to the ON position when finger-pressure is applied along a central region (7*b*) of the finger-engagement portion. However, in certain cases, for instance where finger pressure is applied to a bottom end (7*c*) of the trigger member (7), the trigger member (7) will bend or pivot about the edge (8*b*') of the second lock-off member (8*b*) to such an extent that the levering force applied by the trigger member (7) upon the actuator rod (6) is sufficient to urge the actuator rod (6) inwardly of the switch housing (2) from the OFF position to the ON position even when the lock-off mechanism (8*a*,8*b*) is arranged in the locked-off configuration. This problem is exacerbated as the distance from the edge (8*b*') of the second lock-off member (8*b*) about which the trigger member (7) pivots to the elongate axis (X) of the actuator rod (6) increases due to the greater levering force that may be applied to the actuator rod (6) by the trigger member (7) when the bottom end (7*c*) of the trigger member (7) is pressed. The line (Y) in FIG. 1 illustrates the relative long distance from the edge (8*b*') of the second lock-off member (8*b*) (about which the trigger member (7) pivots) to the elongate axis (X) of the actuator rod (6).

Figure 4:
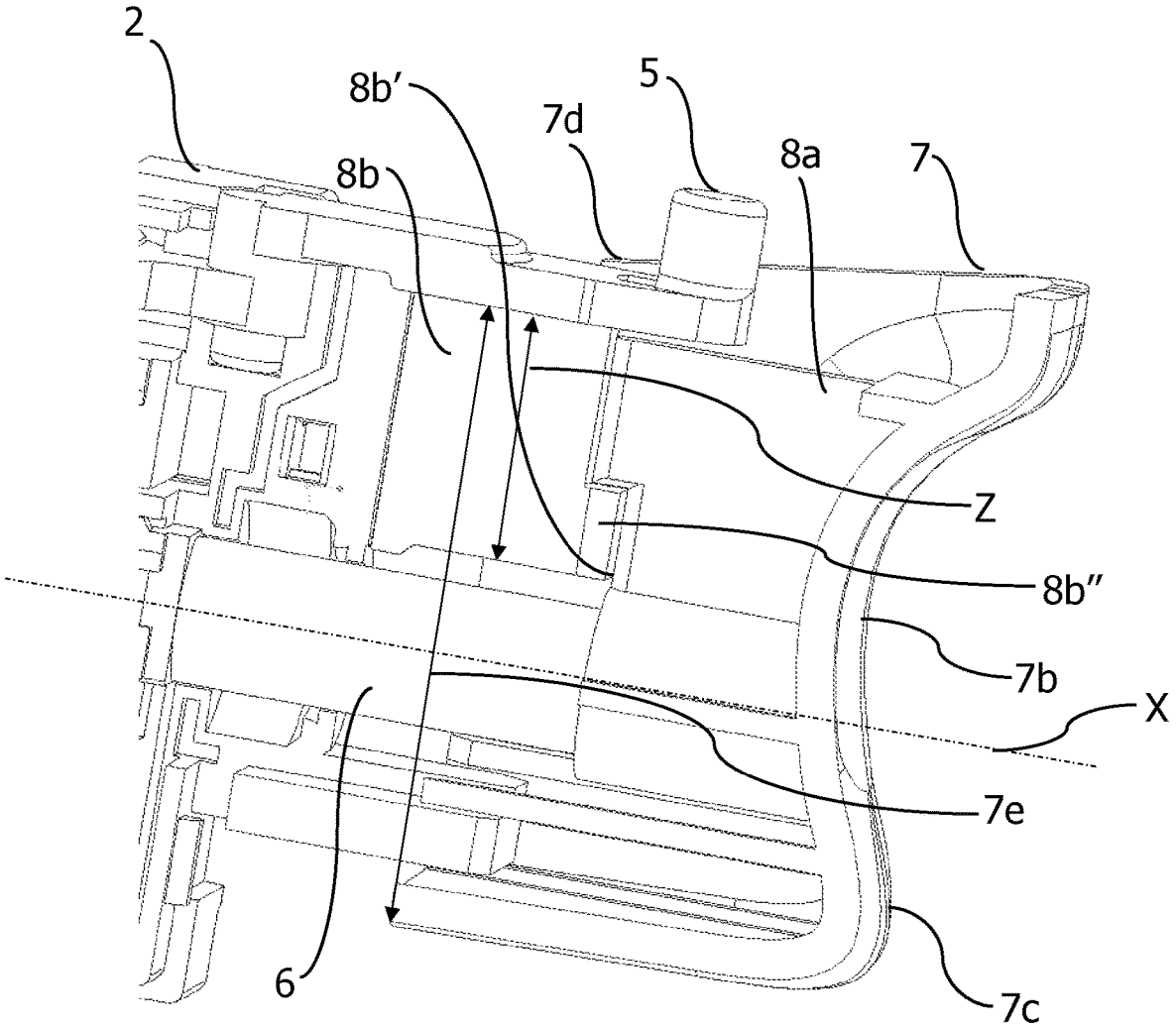
FIGS. 4 and 5 show aspects of a trigger switch assembly for an electric power tool with a novel lock-off mechanism which alleviates movement of the actuator rod inwardly of the housing, when the arranged in a locked-off configuration, even when force is applied to a lower end of the trigger member to pivot or bent the trigger member about an edge of the lock-off mechanism.
Figure 5:
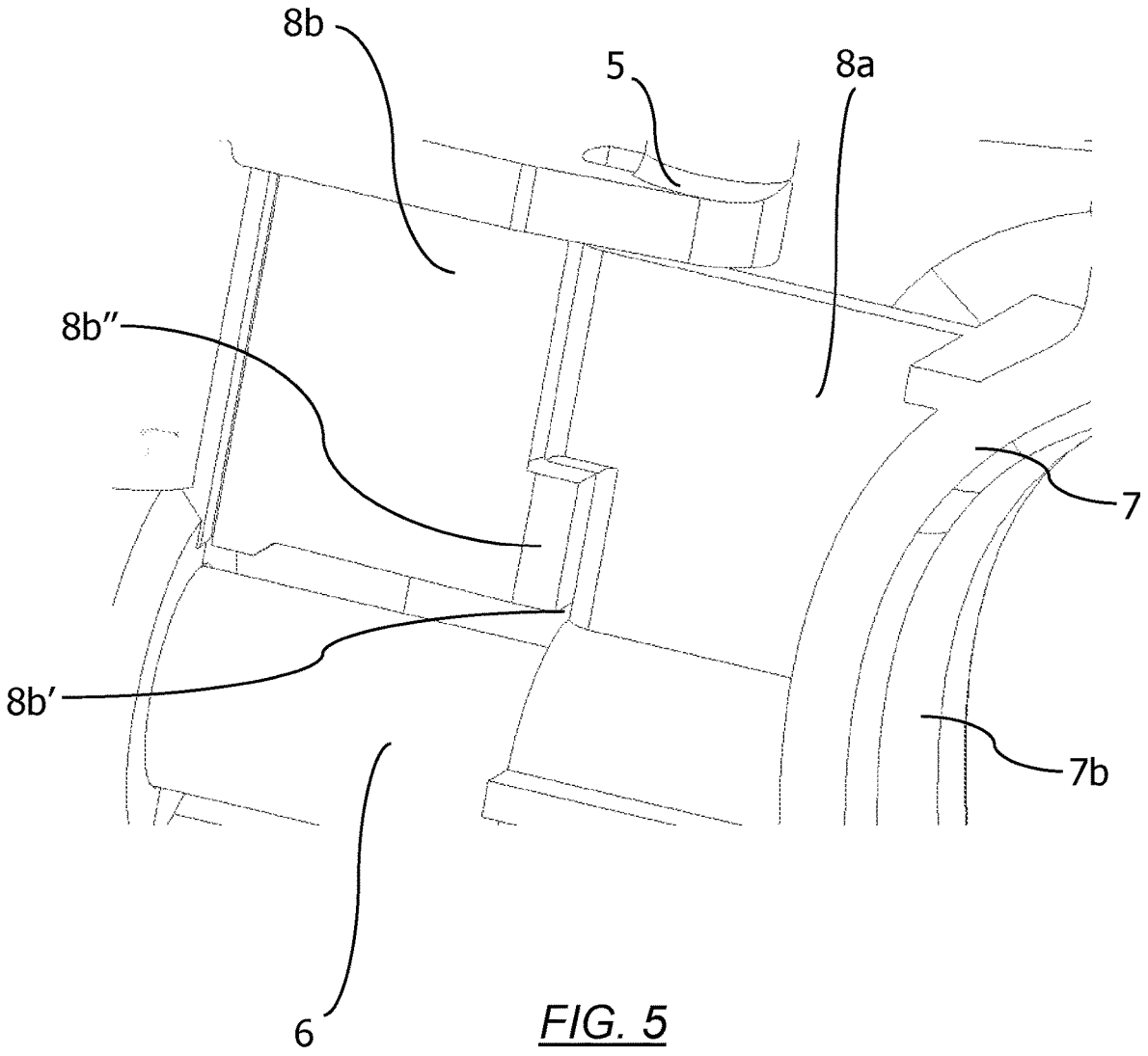

Turning now to FIGS. 4 and 5, aspects of an embodiment (2) of the present invention are now shown which seek to alleviate the above-described problem. The embodiments of the present invention include the same technical features and functional operation as described above but differ in terms of the functional operation of the lock-off mechanism (8*a*,8*b*) as shown in FIGS. 4 and 5. In particular, in the preferred embodiments, when the first and second lock-off members (8*a*,8*b*) of the embodiments shown in FIGS. 4 and 5 are arranged in to the locked-off configuration, the first and second lock-off members (8*a*,8*b*) are shaped and dimensioned so that the actuator rod (6) is restricted from moving along the movement axis (X) from the OFF position in to the ON position in response to urging by the trigger member (7) as the trigger member (7) is pivoted or bent about the edge (8*b*') of the second lock-off member (8*b*) as shown in FIGS. 4 and 5. Further, in these embodiments, both the first and second lock-off members (8*a*,8*b*) as shown in FIGS. 4 and 5 extend substantially along a portion (designated by line Z in FIG. 4) of the first side (7*e*) of the trigger member (7) substantially from the top of the actuator engagement recess (7*a*) to an upper corner (7*d*) of the trigger member (7). By forming the first and second trigger members (8*a*,8*b*) with an elongated length (Z) extending along a portion of the first side (7*e*) of the trigger member (6) in this manner, this alleviates the distance between the edge (8*b*') of the second lock-off member (8*b*) about which the trigger member (7) pivots to the elongate axis (X) of the actuator rod (6), and thereby alleviates the force that may be applied by the trigger member (7) to the actuator rod (6) if finger pressure is applied to a lower end (7*c*) of the trigger member (7) finger-engagement portion. Further, the first and second lock-off members (8*a*,8*b*) include stepped-shape profiles that are configured to complement each other when arranged in the locked-off configuration as shown in FIGS. 4 and 5. As can be seen, the stepped shape of the second-lock member (8*b*) includes a portion (8*b*") that is positioned to obstruct movement of the first lock-off member (8*a*) in a direction downwardly towards the actuator rod (6) when the trigger member (7) is pressed. Advantageously, this further alleviates risk of the first lock-off member (8*a*) inadvertently slipping or shifting downwardly relative to the second lock-off member (8*b*) to the extent that the trigger member (7) may be capable of applying sufficient levering force to move the actuator rod (6) from the OFF to ON position when the lock-off mechanism (8*a*,8*b*) is in the locked-off configuration. In certain alternate embodiments, it is possible that the second lock-off member (8*b*) may be formed on or coupled to other points of contact on the electrical device, and not necessarily to the switch housing (2).

Further, in certain embodiments, such as shown in FIGS. 4 and 5, the second lock-off member (8*b*) includes a wall coupled to the lever (5) and extending downwardly towards the actuator rod from the lever substantially along a majority of the length of the lever. Advantageously, by virtue of the second lock-off member being coupled to and extending downwardly from the lever (5) along a majority of the lever (and preferably along a substantially portion of the lever length) this ensures that the second-lock off member is less susceptible to be broken off from the lever compared to certain conventional trigger assemblies (such as in FIGS. 1-3) in which it can be readily seen that the second-lock member comprises a relatively small portion extending downwardly from the lever from only a small portion of the length of the lever (5).

Figure 6:
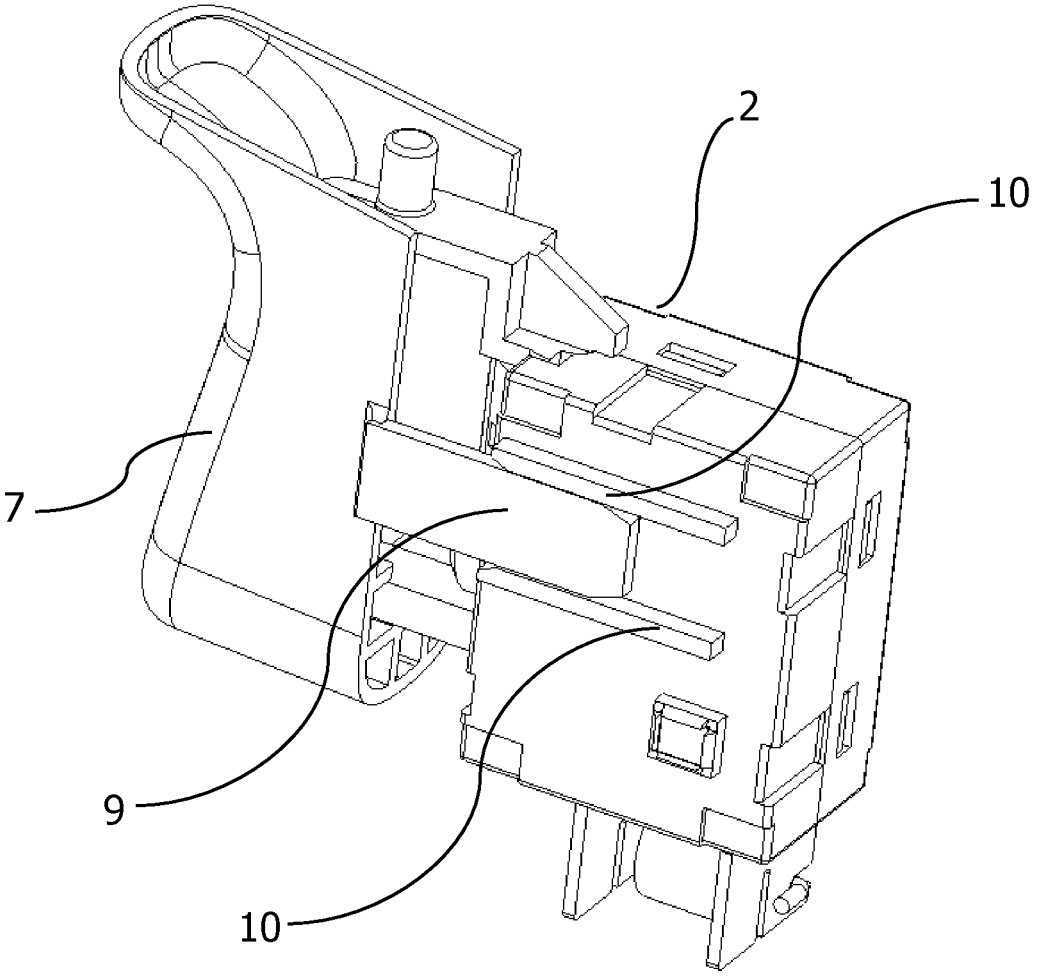
FIG. 6 shows a further aspects of the trigger switch assembly for an electric power tool with a guide rib and guide tracks which co-operate with each other to further alleviate improper bending of the actuator rod when force is applied to a lower end of the trigger member to pivot or bent the trigger member about an edge of the lock-off mechanism.

Referring to FIG. 6, in certain embodiments, a rigid guide rib (9) may be disposed on the trigger (7) and a pair of rigid guide tracks (10) may be disposed on the switch housing (2). The guide rib (9) is configured for being slidably received in a space bounded by the guide tracks (10) so that this may further alleviate improper bending of the actuator rod (6) should when force is applied to a lower end of the trigger member (7) to pivot or bent the trigger member (7) about an edge of the lock-off mechanism. Alternately, the guide rib (9) my instead extend from the switch housing (2) in to guide tracks disposed on the trigger (7).

Those skilled in the art will appreciate that the invention described herein is susceptible to variations and modifications other than those specifically described without departing from the scope of the invention. All such variations and modification which become apparent to persons skilled in the art, should be considered to fall within the spirit and scope of the invention as broadly hereinbefore described. It is to be understood that the invention includes all such variations and modifications. The invention also includes all of the steps and features, referred or indicated in the specification, individually or collectively, and any and all combinations of any two or more of said steps or features.

The reference to any prior art in this specification is not, and should not be taken as, an acknowledgment or any form of suggestion that that prior art forms part of the common general knowledge.

What is claimed is:

1. A trigger switch assembly for use with an electrical device, including:

a switch housing;

a switch circuit disposed within the switch housing, said switch circuit including a movable contact member mounted on a contact lever and a stationary contact member, wherein said contact lever is movable between at least one of a first configuration in which the movable contact member is not in contact with the stationary contact member so as to open the switch circuit, and, a second configuration in which the movable contact member is in contact with the stationary contact member so as to close the switch circuit;

an actuator rod configured for operable-interaction with the contact lever, wherein said actuator rod is configured for movement along an actuator movement axis relative to the switch housing between at least one of an OFF position in which the contact lever is arranged in the first configuration whereby the switch circuit is opened, and, an ON position in which the contact lever is arranged in the second configuration whereby the switch circuit is closed;

a trigger member having an actuator rod engagement recess configured for receiving a first end of the actuator rod therein, and, a finger-engagement portion configured for engagement by a user's finger so as to urge the actuator rod along the actuator movement axis from the OFF position to the ON position;

a lock-off mechanism including a first lock-off member disposed on the trigger member and a second lock-off member that are configured for selectable movement relative to each other between at least one of a locked-off configuration whereby the first lock-off member and the second lock-off member restrict movement of the actuator rod along the actuator movement axis from the OFF position to the ON position, and, a non-locked-off configuration whereby the first lock-off member and the second lock-off member do not restrict movement of the actuator rod along the actuator movement axis from the OFF position to the ON position;

wherein when the first and second lock-off members are arranged in the locked-off configuration, the first and second lock-off members are shaped and dimensioned so that the actuator rod is restricted from moving along the actuator movement axis from the OFF position to the ON position in response to urging by the trigger member as the trigger member is pivoted or bent about an edge of the second lock-off member; and wherein a guide rib is configured for slidable engagement within a pair of guide tracks such that said engagement restricts the actuator rod from moving along the actuator movement axis from the OFF position to the ON position in response to urging by the trigger member as the trigger member is pivoted or bent about the edge of the second lock-off member.

2. The trigger switch assembly of claim 1, wherein the first and second lock-off members include stepped-shapes that are configured to complement each other when arranged in the locked-off configuration.

3. The trigger switch assembly of claim 1, wherein a portion of a stepped-shape of the second lock-off member is configured to obstruct movement of the first lock-off member in a direction towards the actuator rod when the first and second lock-off members are arranged in the locked-off configuration.

4. The trigger switch assembly of claim 1, wherein the actuator rod is configured to be received in the actuator rod engagement recess of the trigger member disposed on a first side of the trigger member, and wherein the first and second lock-off members are shaped and dimensioned to extend along the first side of the trigger member substantially between the actuator engagement recess and a corner of the trigger member.

5. The trigger assembly of claim 1, further including a lever operably-connected with the second lock-off member wherein said lever is operable to move the second lock-off member between locked-off and non-locked-off configurations with the first lock-off member.

6. The trigger assembly of claim 1, wherein the first lock-off member is integrally-formed with the trigger member.

7. The trigger assembly of claim 1, wherein the second lock-off member is coupled to the switch housing.

8. The trigger assembly of claim 1, wherein the trigger member is integrally formed from molded plastic material.

9. The trigger assembly of claim 1, wherein the second lock-off member includes a wall coupled to the contact lever and extending from the contact lever substantially along a majority of a length of the contact lever.

10. The trigger assembly of claim 1, wherein the electrical device includes at least one of an electric power tool and an electric gardening tool.

11. A trigger switch assembly for use with an electrical device, including:

a switch housing;

a switch circuit disposed within the switch housing, said switch circuit including a movable contact member and a stationary contact member, wherein said movable contact member is configured for movement between at least one of a first configuration in which the movable contact member is not in contact with the stationary contact member so as to open the switch circuit, and, a second configuration in which the movable contact member is in contact with the stationary contact member so as to close the switch circuit;

an actuator rod configured for operable-interaction with a contact lever, wherein said actuator rod is configured for movement along an actuator movement axis relative to the switch housing between at least one of an OFF position in which the contact lever is arranged in the first configuration whereby the switch circuit is opened, and, an ON position in which the contact lever is arranged in the second configuration whereby the switch circuit is closed;

a trigger member having an actuator rod engagement recess configured for receiving a first end of the actuator rod therein, and, a finger-engagement portion configured for engagement by a user's finger so as to urge the actuator rod along the actuator movement axis from the OFF position to the ON position;

a lock-off mechanism including a first lock-off member disposed on the trigger member and a second lock-off member coupled to the housing that are configured for selectable movement relative to each other between at least one of a locked-off configuration whereby the first lock-off member and the second lock-off member restrict movement of the actuator rod along the actuator movement axis from the OFF position to the ON position, and, a non-locked-off configuration whereby the first lock-off member and the second lock-off member do not restrict movement of the actuator rod along the actuator movement axis from the OFF position to the ON position, wherein when the first and second lock-off members are arranged in the locked-off configuration, the first and second lock-off members are shaped and dimensioned so that the actuator rod is restricted from moving along the actuator movement axis from the OFF position to the ON position in response to urging by the trigger member as the trigger member is pivoted or bent about an edge of the second lock-off member, and wherein a guide rib is configured for slidable engagement within a pair of guide tracks such that said engagement restricts the actuator rod from moving along the actuator movement axis from the OFF position to the ON position in response to urging by the trigger member as the trigger member is pivoted or bent about the edge of the second lock-off member.

* * * * *